US009440824B2

(12) United States Patent
Stuehrwoldt et al.

(10) Patent No.: US 9,440,824 B2
(45) Date of Patent: Sep. 13, 2016

(54) VEHICLE CRANE WITH DECOUPLABLE COUNTERWEIGHT ASSEMBLY

(71) Applicant: Manitowoc Crane Group France SAS, Dardilly (FR)

(72) Inventors: Dieter Stuehrwoldt, Wilhelmshaven (DE); Stephan Maywald, Wilhelmshaven (DE)

(73) Assignee: Manitowoc Crane Group France SAS (FR)

( * ) Notice: Subject to any disclaimer, the term of this patent is extended or adjusted under 35 U.S.C. 154(b) by 15 days.

(21) Appl. No.: 13/852,378

(22) Filed: Mar. 28, 2013

(65) Prior Publication Data

US 2013/0270209 A1 Oct. 17, 2013

(30) Foreign Application Priority Data

Mar. 30, 2012 (DE) ..... 10 2012 006 494

(51) Int. Cl.
*B66C 23/76* (2006.01)

(52) U.S. Cl.
CPC ..... *B66C 23/76* (2013.01)

(58) Field of Classification Search
CPC ..... B66C 23/72; B66C 23/74; B66C 23/76; B66C 23/53; B66C 2700/0314; B66C 2700/0392; E02F 9/18; B62D 49/085; B62D 49/0628; B66F 9/07544
USPC ..... 212/279, 178, 175, 195–198
See application file for complete search history.

(56) References Cited

U.S. PATENT DOCUMENTS

| | | | |
|---|---|---|---|
| 1,877,373 | A | 9/1932 | Cohen-Venezian |
| 3,547,278 | A | 12/1970 | Tayler |
| 3,924,753 | A | 12/1975 | Lamer et al. |
| 4,168,781 | A | 9/1979 | Bryan, Jr. |
| 4,729,486 | A | 3/1988 | Petzold et al. |
| 4,953,722 | A | 9/1990 | Becker et al. |
| 4,995,518 | A | 2/1991 | McGhie |
| 5,586,667 | A | 12/1996 | Landry |
| 5,799,806 | A | 9/1998 | Cullity |
| 6,341,665 | B1 | 1/2002 | Zhou et al. |
| 6,508,372 | B1 | 1/2003 | Lamphen et al. |
| 6,568,547 | B1 | 5/2003 | Kretschmer et al. |

(Continued)

FOREIGN PATENT DOCUMENTS

| | | |
|---|---|---|
| DE | 34 38 937 A1 | 4/1986 |
| EP | 1 990 306 A2 | 11/2008 |

(Continued)

OTHER PUBLICATIONS

Data Sheet "Potain MR 605 B H32", Manitowoc Crane Group, 8 pgs (2011).

(Continued)

*Primary Examiner* — Sang Kim
*Assistant Examiner* — Juan Campos, Jr.
(74) *Attorney, Agent, or Firm* — Craig Buschmann; Brinks Gilson & Lione

(57) ABSTRACT

A vehicle crane includes a carbody, a turntable rotatably mounted on the carbody, a jib mounted on the turntable that can be tilted about a horizontal axis, and a counterweight assembly mounted on the turntable and can be moved relative to the turntable. A coupler mechanically couples the position of the counterweight assembly to the tilt angle of the jib. The coupler is embodied such that it can be decoupled.

17 Claims, 4 Drawing Sheets

(56) References Cited

U.S. PATENT DOCUMENTS

| | | | |
|---|---|---|---|
| 2002/0070186 | A1 | 6/2002 | Frommelt et al. |
| 2006/0283826 | A1 | 12/2006 | Yeral |
| 2008/0099421 | A1 | 5/2008 | Pech et al. |
| 2008/0203045 | A1 | 8/2008 | Pech et al. |
| 2011/0031202 | A1 | 2/2011 | Pech et al. |

FOREIGN PATENT DOCUMENTS

| | | | |
|---|---|---|---|
| GB | 190594 | | 12/1922 |
| GB | 2353515 | A | 2/2001 |
| JP | S47 11067 | U | 10/1972 |
| JP | S55 120681 | U | 8/1980 |
| JP | S57 56689 | U | 4/1982 |
| JP | 1988032893 | | 3/1988 |
| JP | 10087278 | A | 4/1988 |
| JP | H02 6766 | U | 1/1990 |
| JP | H03-065766 | | 6/1991 |
| WO | WO2005/026036 | A1 | 5/2007 |

OTHER PUBLICATIONS

Grove, T801/T86J Telescopic Boom Work Platforms, 4 pgs (2000).

Manitowoc: M-250 Max-Spander Attachment—Installation and Removal Guide, 16 pgs (1994).

Product Guide "MR Range: Potain", Manitowoc Crane Group, 4 pgs (2007).

KR Office Action of Jul. 31, 2014 (Korean language & translation), for related Korean Patent Application No. 10-2013-0029805.

VEHICLE CRANE WITH DECOUPLABLE COUNTERWEIGHT ASSEMBLY

BACKGROUND OF THE INVENTION

1. Field of the Invention

The present invention relates to a vehicle crane in which the counterweight assembly is coupled to the jib by means of a coupler, such that the position of the counterweight assembly depends on the tilt position of the jib.

Arranging counterweights on the turntable of vehicle cranes in order to counter and at least reduce the moment acting on the turntable from a load on the jib is known from the prior art. Vehicle cranes comprising counterweights that can be varied in their position relative to the turntable, in order to cope with different load conditions on the jib, are also known from the prior art.

2. Description of the Related Art

U.S. Patent Application Publication No. 2008/0099421 discloses a vehicle crane, in particular a crawler crane, in which the counterweights can be moved relative to the turntable by means of a hydraulic cylinder. The position of the counterweight is preferably controlled by computer control. While this moveable counterweight system provides many advantages, there are some instances when a simpler system is more desirable.

U.S. Pat. No. 6,341,665 discloses a movable work platform comprising a jib and a counterweight assembly. In the disclosed aerial work platform, the position of the counterweight assembly relative to the turntable is fixedly coupled to the tilt angle of the jib by means of a lever mechanism, hydraulic cylinders or motors. The proposed counterweight assembly, being close to the tilt axis of the jib, is however less suitable for vehicle cranes such as mobile telescoping cranes, since the amount of counterweight would otherwise have to be increased to generate sufficient counterweight moment. However, due to the maximum allowable weight of the mobile telescoping crane designed to travel over roads, increasing the amount of counterweight would necessitate weight reductions elsewhere, which would ultimately lead to a reduced working load of the vehicle crane. However, if the counterweights are arranged further away from the tilt axis of the jib, there is a danger of the working range of the crane being restricted, since the counterweight would be moved a very long way backwards when the jib is tilted out to its maximum extent.

SUMMARY OF THE INVENTION

It is the object of the present invention to provide a vehicle crane that solves at least some of the problems mentioned above. This object is achieved by a vehicle crane comprising: a carbody; a turntable rotatably mounted on the carbody; a jib mounted on the turntable that can be tilted about a horizontal axis; a counterweight assembly mounted on the turntable that can be moved relative to the turntable; and a coupler that mechanically couples the position of the counterweight assembly to the tilt angle of the jib, wherein the coupler is embodied such that it can be decoupled.

In other words, the position of the counterweight assembly is fixedly coupled to the tilt angle of the jib when the coupler is coupled, and when the coupler is decoupled, the position of the counterweight assembly remains unchanged when the tilt angle is varied. It is thus possible to choose between a coupled state, which enables an increasingly larger counter-moment by the counterweights as the jib is tilted out, and an uncoupled state in which the position of the counterweight assembly relative to the turntable remains fixed, which enables the crane to be used in restricted spaces. In accordance with a preferred embodiment, decoupling should also be possible while the crane is in operation, i.e. not only while it is being assembled.

The term "mechanical coupling" as used herein is intended to express the fact that in accordance with the present invention, the position of the counterweight assembly is made directly, i.e. solely on the basis of physical interaction between the jib and the counterweight assembly, dependent on the tilt angle of the jib. Separately controlling the position of the counterweight assembly, for example by means of a computer together with a sensor system for the tilt angle of the jib, is therefore unnecessary, which significantly reduces the likelihood of the coupler failing.

Any means which allow the force necessary for the movement of the counterweight assembly to be introduced from the jib into the counterweight assembly and vice versa are in principle conceivable as a mechanical coupling, i.e. in other words, the coupler in accordance with the invention is a force transmitter between the jib and the counterweight assembly, which introduces forces from the jib into the counterweight assembly and forces from the counterweight assembly into the jib.

In accordance with a preferred embodiment, the coupler is thus embodied to receive forces, in particular compressive forces, specifically only compressive forces, from the jib and from the counterweight assembly and to relay them to the counterweight assembly or jib, respectively.

In order to fulfill this task, lever mechanisms and gears or also elements that transmit tensile forces such as cable winches and chain blocks and similar devices that are known to the person skilled in the art and suitable for this task are conceivable. A hydraulic coupling that transmits forces between the jib and the counterweight assembly would however also be conceivable. Contrary to the prior art, the necessary forces and/or pressures are thus not generated by means of hydraulic pumps but rather directly by the counterweight assembly and the jib, for example by the force of their weight that acts on pistons.

In accordance with another preferred embodiment, the movement of the counterweight assembly is a horizontal or vertical movement, in particular a horizontal and vertical movement. If the movement of the counterweight assembly is solely horizontal, only the moment that the counterweight assembly exerts on the turntable counter to the jib moment is varied, while a solely vertical movement causes an increase or decrease in the potential energy and/or positional energy of the counterweight assembly, i.e. in the latter case, it is possible to recover the energy expended raising the counterweight assembly and for example use it to tilt the jib in, such that some of the force for tilting the jib in, which would have to be expended by the hydraulic motors provided for that purpose, can be saved.

Such an embodiment has the additional advantage of saving energy, wherein the means necessary for tilting the jib can, as appropriate, be dimensioned to be smaller and therefore lighter. This in turn results in a lower inherent weight of the crane and therefore a further increase in the ratio of load capacity to inherent weight.

In accordance with a particularly preferred embodiment of the present invention, the coupler comprises a linkage comprising at least one coupling rod. Such a coupling rod is suitable for receiving compressive forces and thus functioning as a force transmitter between the jib and the counterweight assembly.

In accordance with another preferred embodiment of the present invention, at least one coupling rod of the coupler linkage is embodied such that at least one force contact of the coupling rod can be spaced (i.e., separated by a physical distance) from a complementary force contact, but both force contacts remain attached to the crane. A force contact is understood to mean a point on the coupling rod at which forces can be introduced into and/or channeled out of the coupling rod. Spacing the coupling rod force contact from a complementary force contact, i.e. a force contact that is otherwise connected to the coupling rod force contact, causes the coupler to be decoupled, since forces can then no longer be transmitted between the complementary force contacts.

It would in principle be conceivable to space complementary force contacts by reducing the axial extension of a coupling rod, for example via a threaded engagement between two coupling rod parts that are screwed into each other along the longitudinal axis of the coupling rod. In accordance with another embodiment, however, the coupling rod is particularly preferably rotated and/or pivoted about another force contact of the coupling rod. In other words, the coupling rod is preferably pivoted and "unhinged". Alternatively or additionally, the coupling rod could be raised or lowered, for example by lowering or raising its force contact which can be arranged on a prop plate of the counterweight assembly, in order to space the complementary force contacts.

In order to space the complementary force contacts as easily and simply as possible, the coupling rod force contact is embodied in accordance with another preferred embodiment in the shape of a fork, such that a complementary force contact that is for example bolt-shaped can engage with the fork-shaped force contact. It is however equally conceivable for the coupling rod force contact to be bolt-shaped and the complementary force contact to be embodied in the shape of a fork.

In order to utilize the advantages of the present invention already mentioned further above, the coupler is embodied in accordance with a particularly preferred embodiment such that tilting the jib out increases the horizontal distance between the counterweight assembly and the tilt axis of the jib and/or raises the vertical position of the counterweight assembly. This means that the counter-moment generated by the counterweights is increased when the jib is tilted out and/or that the potential energy of the jib that is released when it is tilted out is "buffered" by raising the position of the counterweights and is thus available again for subsequently tilting the jib in. A combination of increasing the horizontal distance from the tilt axis of the jib and raising the vertical position of the counterweight assembly is particularly preferred.

A pivoting movement of the counterweight assembly, i.e. a combined rotational/translational movement of the counterweight assembly, is also particularly preferred. This can for example be achieved by mounting the counterweight assembly with respect to the rest of the turntable in a suspended manner. For this purpose, at least two pendulum supports can for example be provided that for example act on at least one bearing arm that projects at least partially in a horizontal direction.

While it is in principle conceivable for the force contact of the coupling rod to act directly on the jib or the counterweight assembly, i.e. for the complementary force contact to be formed directly on the jib or the counterweight assembly, an additional coupling rod on which the complementary force contact is formed is however preferred, i.e. at least two coupling rods are connected in series between the counterweight assembly and the jib.

It is then particularly advantageous if the movement of the at least one additional coupling rod when the jib is tilted relative to the turntable is guided, in particular by means of at least one guide support that is mounted on a bearing point that is fixed with respect to the turntable, wherein the guide support acts on the additional coupling rod, specifically in the region of the complementary force contact, i.e. in other words, the additional coupling rod is guided even when the coupler linkage is in a decoupled configuration, wherein the guide support mounted on the turntable causes a defined movement of the coupling rod relative to the turntable. The defined movement of the coupler linkage is thus not influenced by decoupling.

The counterweights on vehicle cranes are usually mounted at the rearmost end of the turntable. Another preferred embodiment of the present invention correspondingly provides for the coupling rod comprising the force contact that can be spaced to be mounted on the counterweight assembly and/or for the coupling rod comprising the complementary force contact and/or the guided coupling rod to be mounted on the jib. This enables easier decoupling at the rear end of the turntable, wherein the reverse embodiment is in principle also conceivable.

It is also advantageous to embody the counterweight assembly such that it can be locked in position, in order to positionally fix it relative to the turntable when the coupler is decoupled. This prevents the counterweight assembly from undesirably changing its position. Advantageously, different positions can be provided in which the counterweight assembly can be locked in position relative to the turntable. This enables the position and therefore also the counter-moment to be varied when the coupler is decoupled, even for example while the crane is in use, and then fixed in different positions according to requirement, when the coupler is decoupled.

In the following, the invention is described in more detail on the basis of a preferred embodiment. It can comprise any of the features described here, individually and in any expedient combination. In the enclosed figures:

DETAILED DESCRIPTION OF THE PREFERRED EMBODIMENTS

Figure 1:
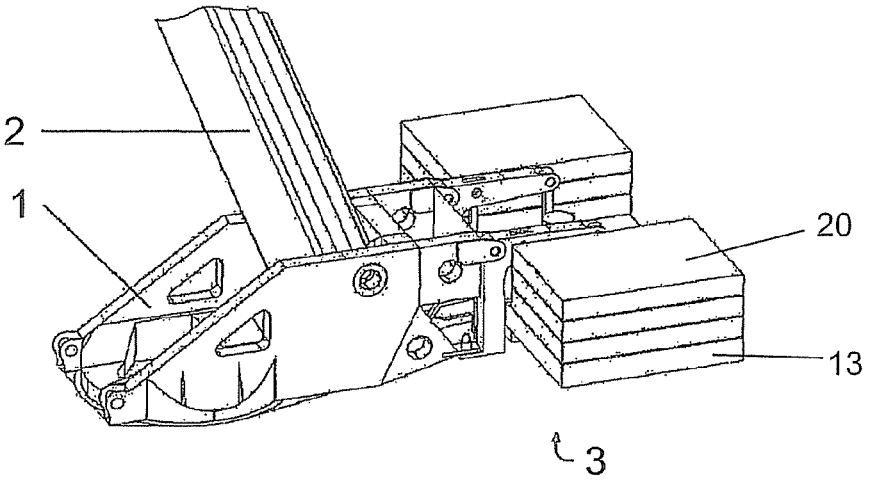
FIG. 1 shows a vehicle crane turntable comprising the counterweight assembly in accordance with the invention.

FIG. 1 shows a turntable 1 of the vehicle crane in accordance with the invention. The turntable, also sometimes referred to as a rotating bed, is rotatably connected to a carbody (not shown), also sometimes referred to as a bogie. The carbody may be conventional in nature, and be in the form of a truck chassis or other carbody that allows the crane to travel on roadways. The carbody may also support crawlers. The jib 2, also sometimes referred to as a boom, is mounted on the turntable 1 about a horizontal tilt axis (not marked) and can be tilted relative to the turntable 1 about said axis. A counterweight assembly 3 that is shown at the rear end of the turntable 1 comprises counterweight blocks 20, a base plate 13 and a prop plate 14, best seen in FIG. 2.

Figure 2:
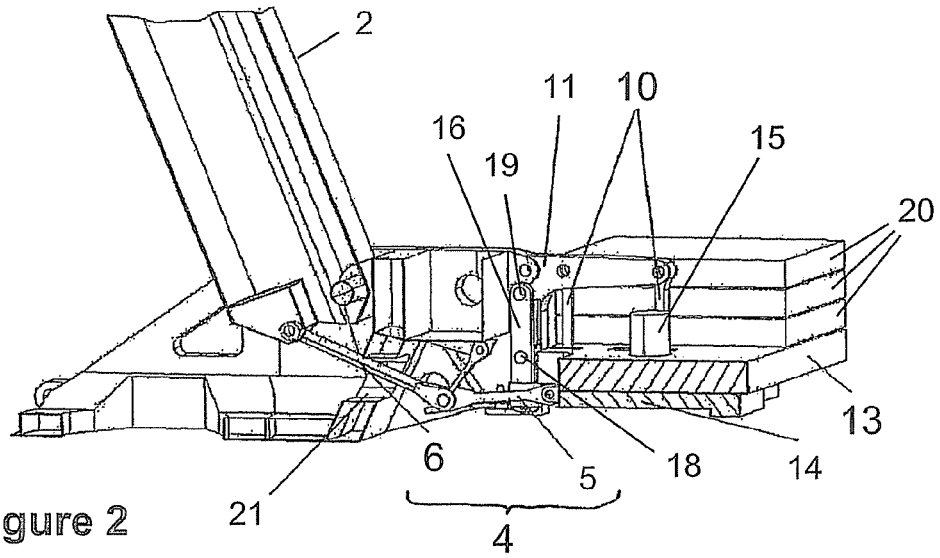
FIG. 2 shows the turntable from FIG. 1 in a vertical longitudinal section.

In the vertical longitudinal section of the turntable in FIG. 2, the base plate 13 is shown together with a lifting cylinder 15 that connects between the base plate 13 and the prop plate 14, wherein the counterweight blocks 20 are mounted on the base plate 13. The coupler 4, which comprises the coupling rods 5 and 6, is also shown wherein the coupling rod 5 acts, rotationally mounted, on the prop plate 14 of the counterweight assembly 3 and is in engagement with another coupling rod 6 that acts, rotationally mounted, on the lower end of the jib. It is evident from FIG. 2 alone that when the jib 2 is tilted out about the tilt axis, the coupling rod 6 is shifted substantially horizontally towards the counterweight assembly 3, wherein the coupling rod 5 that is connected to it is likewise moved towards the counterweight assembly 3, which in turn displaces the counterweight assembly 3 to the right, wherein the counterweight assembly 3 is mounted with respect to the rest of the turntable in a suspended manner, on the bearing arm 11 that projects horizontally backwards, such that it can be pivoted on four pendulum supports 10 (only two of which are shown by the central longitudinal section). Due to this mounting arrangement, it is clear that tilting the jib 2 out causes a pivoting movement of the counterweight assembly 3 backwards away from the tilt axis of the jib and simultaneously displaces the counterweight assembly 3 upwards.

Figure 3:
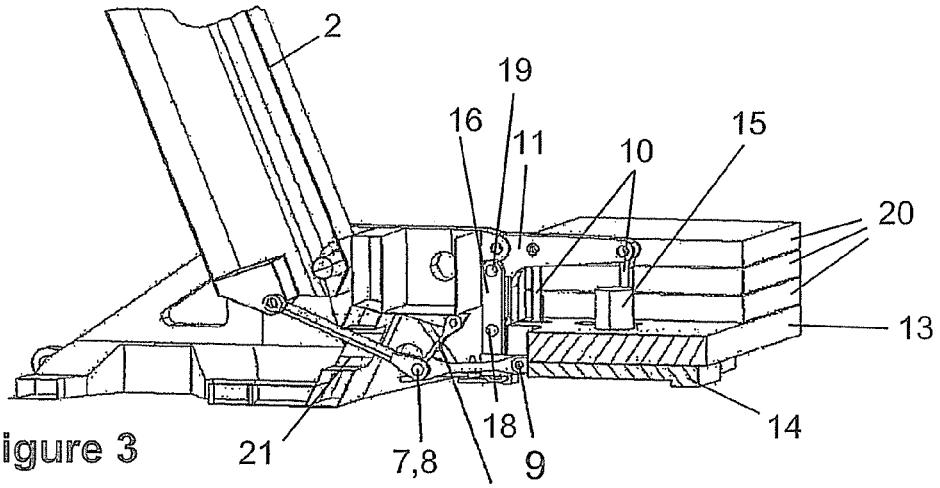
FIGS. 3 and 4 show the turntable from FIG. 2 when the jib is tilted in/out, with the coupler coupled.
Figure 4:
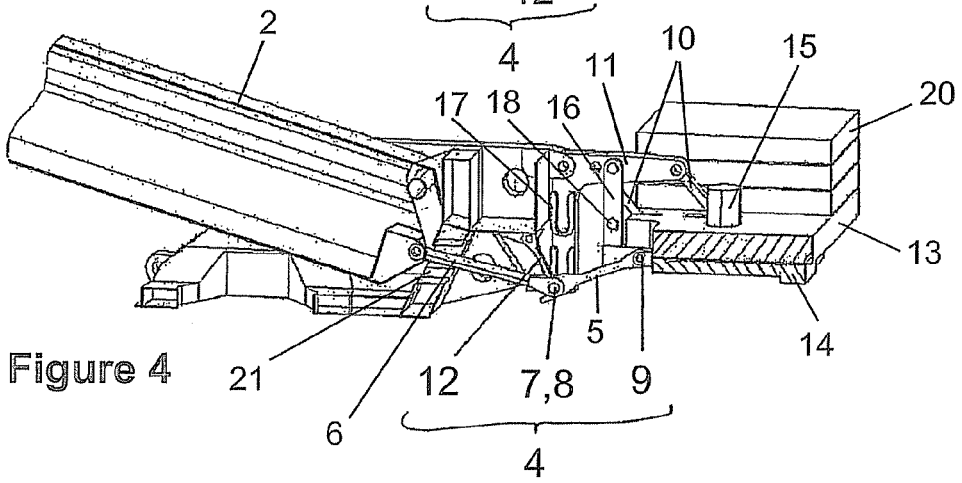

This can be seen particularly well from FIGS. 3 and 4, wherein FIG. 3 shows the jib 2 tilted in, and FIG. 4 shows the jib 2 tilted out. These figures also show a guide support 12 that acts on the coupling rod 6 in the region of the force contacts 7 and 8 of the coupling rods 5 and 6 and therefore guides the two coupling rods 5 and 6 during the tilting movement of the jib 2. The movement of the coupling rod 6 through an aperture 21 in the turntable is also shown.

Figure 5:
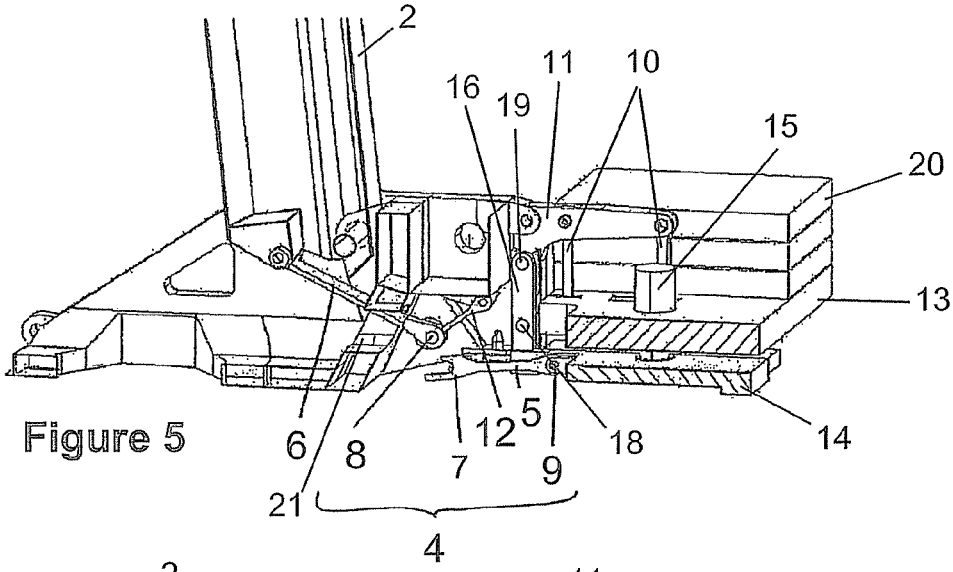
FIGS. 5 and 6 show the turntable from FIG. 2 when the jib is tilted in/out, with the coupler uncoupled.
Figure 6:
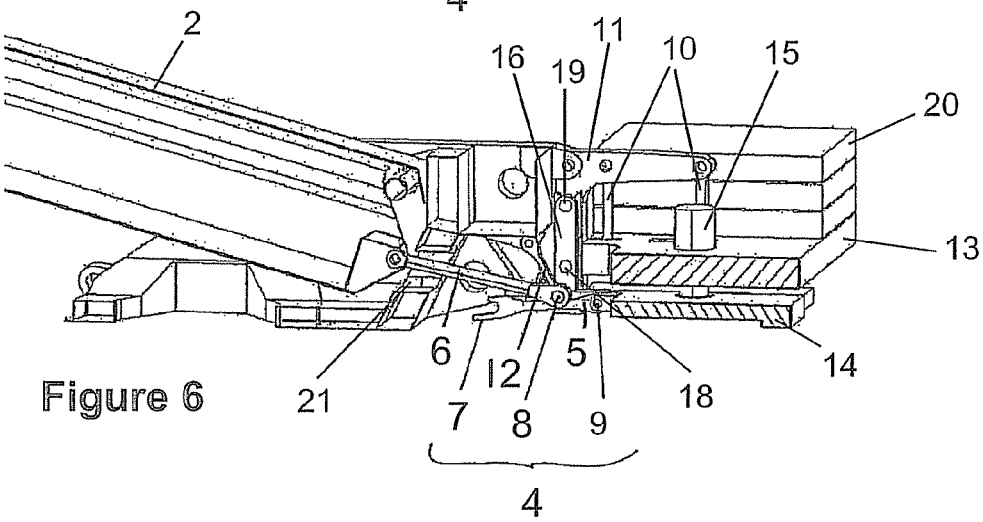

FIGS. 5 and 6, like FIGS. 3 and 4 before them, also show the jib 2 tilted in and tilted out, respectively, but in this case with the coupler 4 uncoupled. By shifting the coupling rod 5 by means of the prop plate 14 being lowered by the lifting cylinder 15 situated between the base plate 13 and the prop plate 14, it is possible to "unhinge" the fork-shaped force contact 7 from the complementary bolt-shaped force contact 8 of the coupling rod 6, wherein a guide for the coupling rod 6 is again provided by the guide support 12. Lowering the prop plate 14 by extending cylinder 15 moves the counterweight assembly into a locked position in order to prevent undesirable changes in position due to crane movements when the coupler is decoupled. Pins 18 and 19 on upright members 16 fit within a U-shaped receptacles 17 (best seen in FIG. 4) to lock the counterweight assembly into a fixed position with respect to arm 11, and thus to the turntable 1. Simultaneously the fork-shaped coupling rod 5 is lowered together with the prop plate 14, thereby preventing further coupling of coupling rods 5 and 6. Due to the decoupling, the tilting movement of the jib no longer changes the position of the counterweight assembly 3; instead, the coupling rod 6 can be freely moved through the coupler 4.

Figure 7:
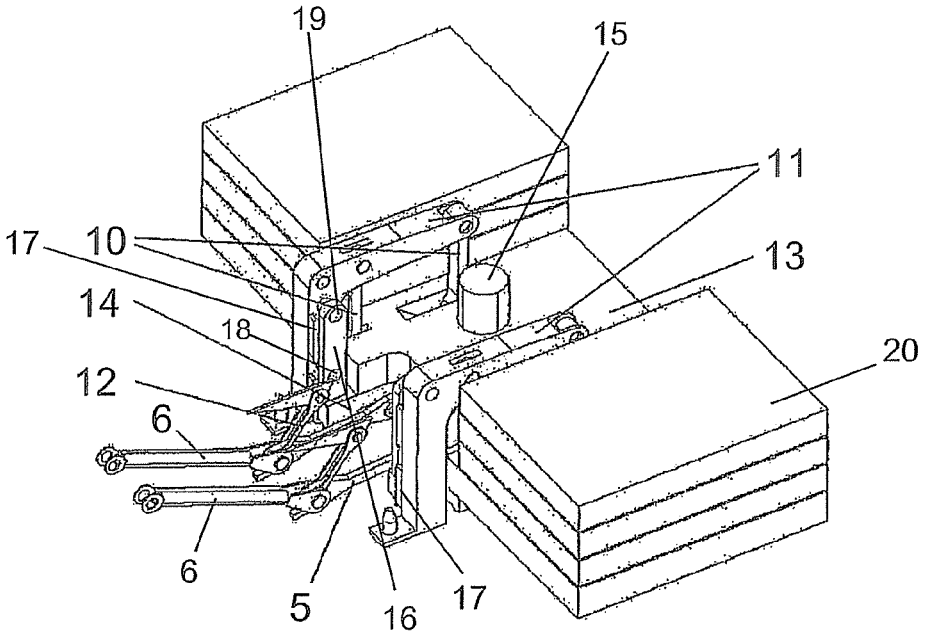
FIG. 7 shows the coupler linkage without the turntable.

FIG. 7 offers a view of the complete lever kinematics of the coupler 4, without the turntable 1 and the jib 2. Two coupling rods 5 comprising fork-shaped force contacts 7 engage with the bolt-shaped force contacts 8 of the jib-end coupling rods 6, wherein two supports 12 arranged on both sides of the force contacts 7 and 8 respectively ensure that the coupling rods 5 and 6 are guided during the tilting movement of the jib 2.

What is claimed is:

1. A vehicle crane, comprising:

a) a carbody;

b) a turntable rotatably mounted on the carbody;

c) a jib mounted on the turntable that can be tilted about a horizontal axis;

d) a counterweight assembly mounted on the turntable that can be moved relative to the turntable; and e) a coupler that includes at least one coupling rod that mechanically couples a position of the counterweight assembly to a tilt angle of the jib, the at least one coupling rod having at least one force contact for introducing and channeling out a compressive force, the at least one force contact being adapted to be separated from a complementary force contact of the coupler by a force acting on the at least one coupling rod in a direction opposite to the direction of the compressive force that is channeled out of the force contact and introduced into the complementary force contact, wherein when the at least one force contact is separated from the complementary force contact the coupler no longer mechanically couples the position of the counterweight assembly to the tilt angle of the jib, wherein the at least one force contact and the complementary force contact remain attached to the crane when the at least one force contact and the complementary force contact are separated, and wherein when the at least one coupling rod is in contact with the complementary force contact of the coupler, the at least one coupling rod is embodied to receive only the compressive force from the jib and from the counterweight assembly and to relay the compressive force between the counterweight assembly and the jib, whenever the jib is tilted inward towards the turntable and whenever the jib is tilted outward away from the turntable.

2. The vehicle crane in accordance with claim 1 wherein the coupler receives a compressive force.

3. The vehicle crane in accordance with claim 1 wherein a movement of the counterweight assembly relative to the turntable is a combination of a horizontal and a vertical movement.

4. The vehicle crane in accordance with claim 1 wherein the coupler comprises a linkage that couples the at least one force contact of the at least one coupling rod to the complementary force contact of the coupler.

5. The vehicle crane in accordance with claim 4 further comprising at least one additional coupling rod, wherein the at least one additional coupling rod includes the complementary force contact of the coupler.

6. The vehicle crane in accordance with claim 5 wherein a movement of the at least one additional coupling rod when the jib is tilted relative to the turntable is configured to be guided by at least one guide support that is mounted on a bearing point that is fixed with respect to the turntable, and wherein the at least one guide support acts on the at least one additional coupling rod in the region of the complementary force contact.

7. The vehicle crane in accordance with claim 5 wherein the at least one coupling rod comprising the force contact that is configured to be separated is mounted on the counterweight assembly.

8. The vehicle crane in accordance with claim 5 wherein the at least one additional coupling rod is mounted on the jib.

9. The vehicle crane in accordance with claim 1 wherein the at least one force contact and the complementary force contact are configured to be separated by shifting the at least one coupling rod by lowering a prop plate of the counterweight assembly.

10. The vehicle crane in accordance with claim 1 wherein the at least one force contact that is configured to be separated is embodied in the shape of a fork in order to allow the complementary force contact to engage with the at least one force contact.

11. The vehicle crane in accordance with claim 1 wherein the coupler is embodied such that tilting the jib out increases a horizontal distance between the counterweight assembly and a tilt axis of the jib.

12. The vehicle crane in accordance with claim 1 wherein the coupler is embodied such that tilting the jib out raises a vertical position of the counterweight assembly.

13. The vehicle crane in accordance with claim 1 wherein the coupler is embodied such that tilting the jib out increases a horizontal distance between the counterweight assembly and a tilt axis of the jib and raises a vertical position of the counterweight assembly.

14. The vehicle crane in accordance with claim 1 wherein a movement of the counterweight assembly is a pivoting movement.

15. The vehicle crane in accordance with claim 1 wherein the counterweight assembly is suspended on the turntable.

16. The vehicle crane in accordance with claim 15 wherein the counterweight assembly is mounted by at least two pendulum supports that act on at least one bearing arm that projects at least partially in a horizontal direction.

17. The vehicle crane in accordance with claim 1 wherein the counterweight assembly is embodied to be locked in position relative to the turntable.

* * * * *